US009826846B1

(12) United States Patent
Woody

(10) Patent No.: US 9,826,846 B1
(45) Date of Patent: Nov. 28, 2017

(54) POTTED PLANT HOLDER

(76) Inventor: Catherine Woody, Brooklyn, NY (US)

( * ) Notice: Subject to any disclaimer, the term of this patent is extended or adjusted under 35 U.S.C. 154(b) by 0 days.

(21) Appl. No.: 13/555,249

(22) Filed: Jul. 23, 2012

Related U.S. Application Data

(63) Continuation-in-part of application No. 12/806,889, filed on Aug. 24, 2010, now abandoned.

(51) Int. Cl.
*A47G 7/04* (2006.01)
*A47G 7/00* (2006.01)

(52) U.S. Cl.
CPC ..... *A47G 7/044* (2013.01); *A47G 7/04* (2013.01); *A47G 7/00* (2013.01)

(58) Field of Classification Search
CPC . A47G 7/00; A47G 7/04; A47G 7/041; A01G 5/04; A61G 17/04; A61G 2017/045; A47F 5/01
USPC ..... 248/693, 27.8, 317, 318, 328, 912; 47/65.5, 65.7, 65.8, 66.1, 66.6, 67; 211/36, 90.01, 90.02, 90.04, 85.23, 88.03, 211/113
See application file for complete search history.

(56) References Cited

U.S. PATENT DOCUMENTS 363,113 A * 5/1887 Burrell et al. ..... B66C 1/127 119/728
1,026,690 A * 5/1912 McGavin ..... A47G 1/18 24/129 R
1,088,939 A * 3/1914 Snee ..... B66C 1/127 294/157
2,272,494 A * 2/1942 Winslow ..... B66B 37/06 182/112
2,279,237 A * 4/1942 Kellems ..... A47L 13/512 211/66
3,709,373 A * 1/1973 Aguilar ..... A47F 5/0892 211/113
D235,601 S * 7/1975 Lewis ..... 47/67
D237,333 S 10/1975 Knowles
3,915,419 A * 10/1975 Brown ..... A47G 7/047 248/318
4,063,387 A 12/1977 Mitchell
D253,382 S * 11/1979 Spruiel ..... D11/144
4,181,234 A * 1/1980 Feighan ..... A47G 7/047 211/113
4,227,669 A * 10/1980 McInnis ..... H04R 1/026 211/113

(Continued)

OTHER PUBLICATIONS http://www.ebay.com/itm/Macrame-Plant-Hanger-with-BEADs-72in-3-TIER-Sand-/330324441018?#ht_2163wt_1014.*
http://www.ebay.com/itm/370397301323?ru=http%3A%2F%2Fwww.ebay.com%2Fsch%2Fi.html%3F_sacat%3D0%26_from%3DR40%26_nkw%3D370397301323%26_rdc%3D1.*
http://davesgarden.com/guides/articles/view/741/.*

*Primary Examiner* — Muhammad Ijaz

(57) ABSTRACT

A potted plant holder is provided and comprises three ropes positioned adjacent each other and folded thereby creating six strands. A hanging knot is formed in the combined ropes creating a hanging loop with the strands hanging below the hanging knot. Below the hanging knot, a first knot is tied in the first and second strands, a second knot is tied in the third and fourth strands, and a third knot is tied in the fifth and sixth strands. Below the first, second, and third knots, a fourth knot is tied in the first and sixth strands, a fifth knot is tied in the second and third strands, and a sixth knot is tied in the fourth and fifth strands. A support knot is tied the strands below the fourth, the fifth, and the sixth knots wherein a first plant pot positioned between the strands rests on the support knot.

1 Claim, 3 Drawing Sheets

(56) References Cited

U.S. PATENT DOCUMENTS

| | | | | | |
|---|---|---|---|---|---|
| 4,262,873 | A * | 4/1981 | Prenger | A47G 7/047 | 248/318 |
| D265,611 | S * | 8/1982 | Knudson | D6/347 | |
| 4,520,979 | A * | 6/1985 | McInnis | H04N 5/64 | 248/317 |
| 4,741,124 | A * | 5/1988 | Scism | A47G 7/047 | 47/67 |
| 4,877,210 | A * | 10/1989 | Missalla | A47G 7/047 | 248/318 |
| 4,991,802 | A * | 2/1991 | Deacon | H02G 11/003 | 248/328 |
| 5,052,148 | A * | 10/1991 | Sharon | A47G 7/047 | 248/328 |
| 5,779,210 | A * | 7/1998 | Canson | A47G 7/047 | 248/318 |
| 5,788,223 | A * | 8/1998 | Stockton | A01K 3/00 | 256/2 |
| 5,836,109 | A * | 11/1998 | Kunz | A47G 7/047 | 248/318 |
| 6,123,238 | A * | 9/2000 | Dumplet | A47F 5/0006 | 211/113 |
| 7,726,072 | B1 | 6/2010 | Kuslaka et al. | | |
| 2009/0212187 | A1* | 8/2009 | Chen | A47G 7/047 | 248/318 |
| 2010/0000149 | A1* | 1/2010 | Ouellet | A01G 9/021 | 47/32.7 |
| 2013/0133254 | A1* | 5/2013 | O'Brien | A47G 7/047 | 47/65.7 |

* cited by examiner

POTTED PLANT HOLDER

The present application is a continuation-in-part of pending patent application Ser. No. 12/806,889, filed on Aug. 24, 2010, entitled "Potted Plant Holder".

BACKGROUND OF THE INVENTION

1. Field of the Invention

This invention relates generally to a potted plant holder and, more particularly, the invention relates to a potted plant holder for enhancing the display of indoor plants.

2. Description of the Prior Art

Many people enjoy houseplants. In fact, raising them is one of the fastest growing indoor hobbies. An integral part of indoor decor, especially in winter, caring for houseplants offers satisfying opportunities for people who like to work with living things and watch them develop. Plants are not only beautiful in the home, but they also help cleanse the air. Fulfilling a unique niche in the indoor landscape, a few strategically placed large indoor plants can transform virtually any ordinary space into a slice of the tropics.

SUMMARY

The present invention includes a potted plant holder comprising a first rope having a first end and a second end, a second rope having a first end and a second end, and a third rope having a first end and a second end with the first rope, the second rope, and the third rope being positioned adjacent each other. A first strand, a second strand, a third strand, a fourth strand, a fifth strand, and a sixth strand are created by folding the ropes with the first ends adjacent the second ends. A hanging knot is formed in the combined ropes at a position between the first ends and the second ends creating a hanging loop with the strands hanging below the hanging knot. A first knot is tied in the first strand and the second strand a predetermined distance below the hanging knot, a second knot is tied in the third strand and the fourth strand the predetermined distance below the hanging knot, and a third knot is tied in the fifth strand and the sixth strand the predetermined distance below the hanging knot. A fourth knot is tied in the first strand and the sixth strand a predetermined distance below the first knot and the third knot, a fifth knot is tied in the second strand and the third strand the predetermined distance below the first knot and the second knot, and a sixth knot is tied in the fourth strand and the fifth strand the predetermined distance below the second knot and the third knot. A first support knot is tied in all of the strands a predetermined distance below the fourth knot, the fifth knot, and the sixth knot. Upon positioning a first plant pot between the strands, the first plant pot rests on the first support knot.

DETAILED DESCRIPTION OF THE PREFERRED EMBODIMENTS

Figure 1:
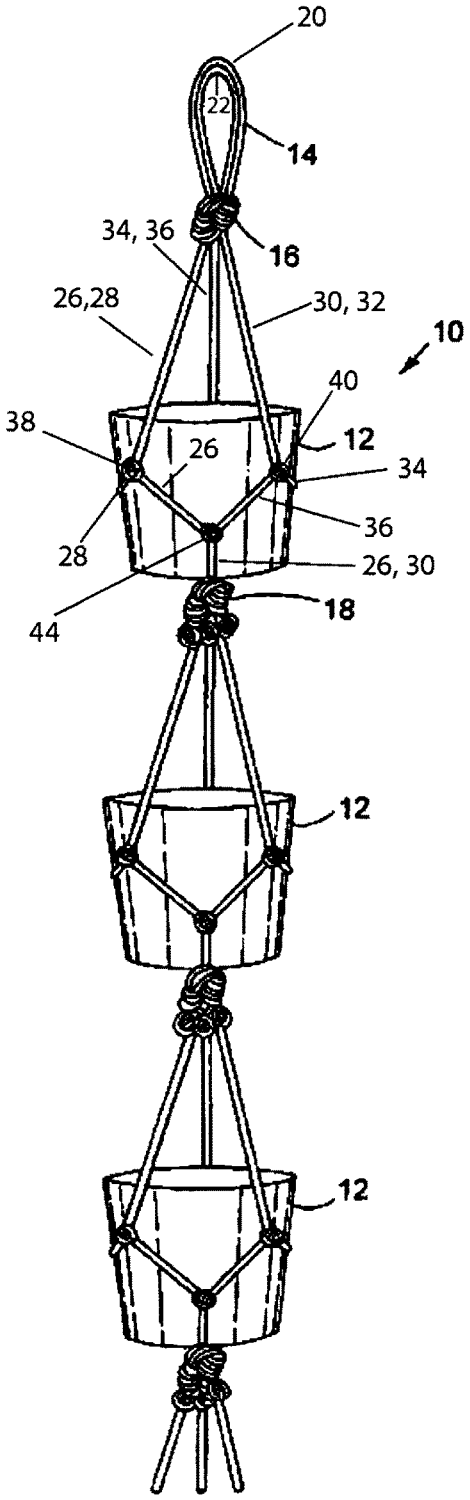
FIG. 1 is a perspective view illustrating a potted plant holder, constructed in accordance with the present invention with three plant pots hanging downward, with each plant pot separately tied in a knotted fashion.
Figure 2:
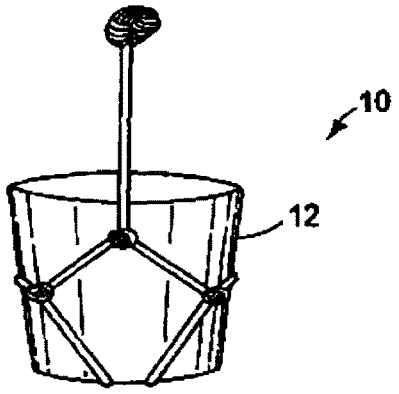
FIG. 2 is a rear view illustrating the potted plant holder, constructed in accordance with the present invention, showing positioning of the ropes for hanging the plant pot with the knots evenly space around the plant pots.
Figure 3:
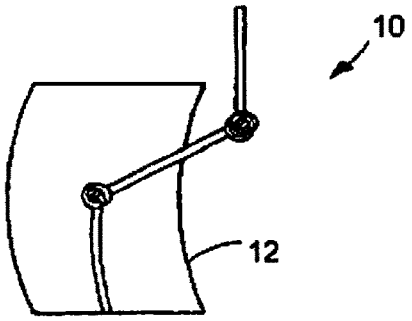
FIG. 3 is a left side view illustrating the potted plant holder, constructed in accordance with the present invention, with the rope along the side of the plant pot.
Figure 4:
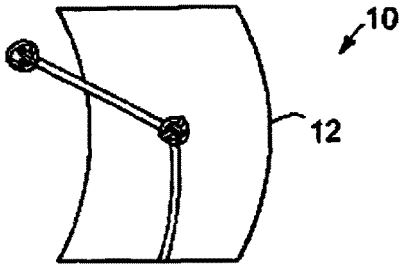
FIG. 4 is a right side view illustrating the potted plant holder, constructed in accordance with the present invention, with the rope along the side of the plant pot.
Figure 5:
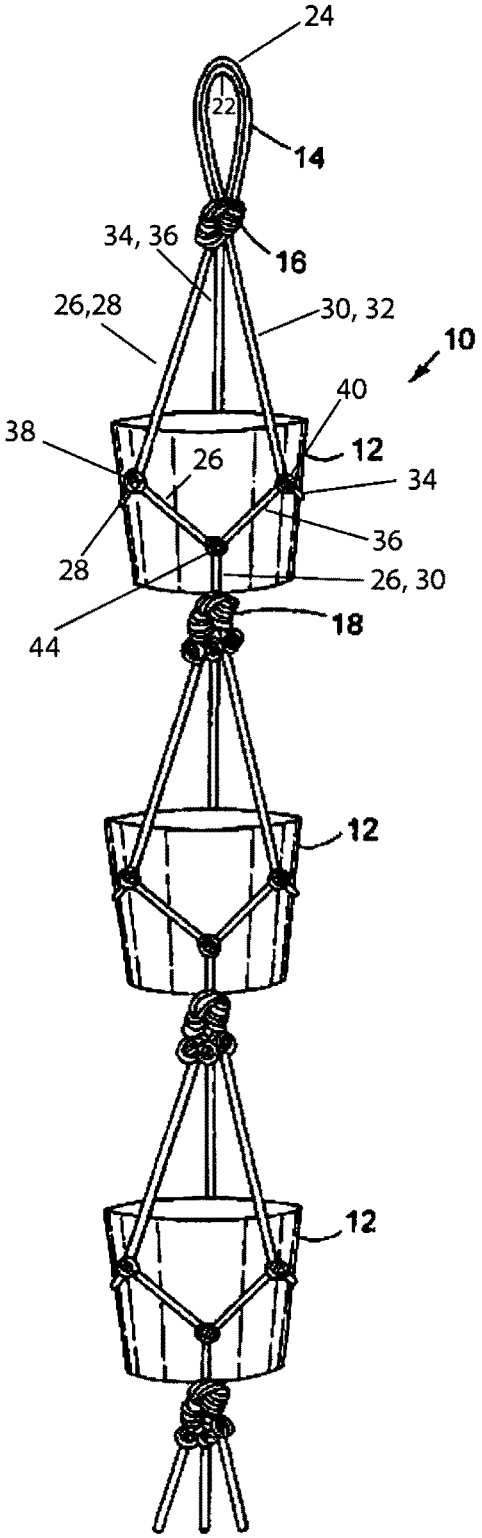
FIG. 5 is another perspective view illustrating the potted plant holder, constructed in accordance with the present invention.

As illustrated in FIGS. 1-4, the present invention is a potted plant holder, indicated generally at 10, for enhancing the display of indoor and outdoor plants and offering the advantages of having plants in the home. Plants bring oxygen to the household creating a healthy living space. In addition, the potted plant holder 10 of the present invention with a creative display of plants beautifies any room in the house.

The potted plant holder 10 of the present invention is a three-tiered, adjustable holder to accommodate the plant pots 12 of hanging plants. The potted plant holder 10 is constructed of a braided coiled rope or similar suspendable cordage, the potted plant holder 10 measures approximately five (5') feet to seven (7') feet in length. As such, the potted plant holder 10 accommodates virtually any room, whether it has a low or high ceiling.

With an intricate roped design, the top of the potted plant holder 10 of the present invention contains an open ring 14 for hanging from a hook or the like. The rope extends downward with a series of loops surrounding the rope allowing each of the three sections to be adjusted for height, if necessary. To house the potted plants themselves, three rope bays are evenly spaced apart in a vertical fashion. The bays are expandable as well, easily accommodating pots of various sizes and weights. While the potted plant holder 10 is particularly ideal for household plant lovers, the multitude of businesses that decorate their establishments with greenery will certainly find the potted plant holder 10 an invaluable aid in proper plant care and maintenance. Fabricated of durable, high quality materials and components, the potted plant holder 10 will withstand years of continued use.

In order to construct the potted plant holder 10 of the present invention, a large hanging knot 16 is tied at the top creating the loop 14 for the hanger. The remaining vertical hanging ropes beneath the hanging knot 16 are tied two at a time with the knots being tied in the same manner and the same distance from the top hanging knot 16, approximately 12 inches from the hanging knot 16. The ropes are tied two at a time approximately 6 inches from the hanging knot 16 to accommodate one placing a plant pot 12 through the hanging ropes, making it easy to place the plant pot 12 into the knotted strings. The second knots are tied in the same fashion approximately 5 to 6 inches apart from the other small tied knots, then all six rope strings that are hanging are tied together into a support 18. Then the six hanging strings which are beneath the support knot 18 are tied; tie two at a time until finished in the same fashion as the first. Continue, the second process in the same manner as you did in the first process until all the strings are tied. When you have six knots small knots tied uniquely, two at a time, but separately, approximately 5 to 6 inches apart then tie all six strings together in the same manner as you did in the first or second, process, forming one big knot so that the base of the plant pot 12 will have a resting place. Directly beneath that large tied knot, tie all six strings separately, again, two at a time to form small knots beneath the large knot. Continue this process until all three baskets have been made. With the small knots tied beneath the large knot in the final process, there is no possible way a heavy plant pot 12 placed in the basket can slip downward unless you manually adjust the knots.

In sum, the present invention includes a potted plant holder 10 comprising a first rope 20 having a first end and a second end, a second rope 22 having a first end and a second end, and a third rope 24 having a first end and a second end with the first rope 20, the second rope 22, and the third rope 24 being positioned adjacent each other. A first strand 26, a second strand 28, a third strand 30, a fourth strand 32, a fifth strand 34, and a sixth strand 36 are created by folding the ropes 20, 22, 24 with the first ends adjacent the second ends. The hanging knot 16 is formed in the combined ropes 20, 22, 24 at a position between the first ends and the second ends creating the hanging loop 14 with the strands hanging below the hanging knot 16. A first knot 38 is tied in the first strand 26 and the second strand 28 a predetermined distance below the hanging knot 16, a second knot 40 is tied in the third strand 30 and the fourth strand 32 a predetermined distance below the hanging knot 16, and a third knot 42 is tied in the fifth strand 34 and the sixth strand 36 a predetermined distance below the hanging knot 16. A fourth knot 44 is tied in the first strand 26 and the sixth strand 36 a predetermined distance below the first knot 38 and the third knot 42, a fifth knot 46 is tied in the second strand 28 and the third strand 30 a predetermined distance below the first knot 38 and the second knot 40, and a sixth knot (not shown) is tied in the fourth strand 32 and the fifth strand 34 a predetermined distance below the second knot 40 and the third knot 42. The first support knot 18 is tied in all of the strands a predetermined distance below the fourth knot 44, the fifth knot 46, and the sixth knot 48. Upon positioning a first plant pot 12 between the strands, the first plant pot 12 rests on the first support knot 18.

In a preferred embodiment of the potted plant holder 10 of the present invention, the plant pots 12 have a center line. Preferably, the upper knots are positioned above the center line and the lower knots are positioned below the center line. By positioning the knots, as described and illustrated, the plant pot 12 is securely held between the ropes even when filled with planting soil and plants and during watering.

The potted plant holder 10 of the present invention makes the care and display of indoor potted plants extremely easy and convenient. Extremely easy to use, the potted plant holder 10 can beautify any room in a matter of minutes.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein may be suitably practiced in the absence of the specific elements which are disclosed herein.

What is claimed is:

1. A three-tiered potted plant holder consisting of:

a first rope having a first end and a second end;

a second rope having a first end and a second end;

a third rope having a first end and a second end;

the first rope, and the second rope, and the third rope being positioned adjacent each other;

a first strand, a second strand, a third strand, a fourth strand, a fifth strand, and a sixth strand created by folding said first, second and third ropes with the respective first ends adjacent the second respective ends, a hanging knot formed by said first, second and third ropes at a position between the first ends and the second ends creating a hanging loop, the strands hanging below the hanging knot;

a first knot tied in the first strand and the second strand at a predetermined distance below the hanging knot;

a second knot tied in the third strand and the fourth strand at a predetermined distance below the hanging knot;

a third knot tied in the fifth strand and the sixth strand at a predetermined distance below the hanging knot;

a fourth knot tied in the first strand and the sixth strand at a predetermined distance below the first knot and the third knot;

a fifth knot tied in the second strand and the third strand at a predetermined distance below the first knot and the second knot;

a sixth knot tied in the fourth strand and the fifth strand at a predetermined distance below the second knot and the third knot; and a first support knot tied in said first, second, third, fourth, fifth and sixth strands at a predetermined distance below the fourth knot, the fifth knot, and the sixth knot;

wherein, a first plant pot is configured to rest on the first support knot a seventh knot tied in the first strand and the second strand at a predetermined distance below the first support knot;

an eighth knot tied in the third strand and the fourth strand at a predetermined distance below the first support knot;

a ninth knot tied in the fifth strand and the sixth strand at a predetermined distance below the first support knot;

a tenth knot tied in the first strand and the sixth strand at a predetermined distance below the seventh knot and the ninth knot;

an eleventh knot tied in the second strand and the third strand at a predetermined distance below the seventh knot and the eighth knot;

a twelfth tied knot in the fourth strand and the fifth strand at a predetermined distance below the eighth knot and the ninth knot; and a second support knot tied in said first, second, third, fourth fifth and sixth strands at a predetermined distance below the tenth knot, the eleventh knot and the twelfth knot;

wherein a second plant pot is configured to rest upon the second plant support knot;

a thirteenth knot tied in the first strand and the second strand at a predetermined distance below the second support knot;

a fourteenth knot tied in the third strand and the fourth strand at a predetermined distance below the second support knot;

a fifteenth knot tied in the fifth strand and sixth strand at a predetermined distance below the second support knot;

a sixteenth knot tied in the first strand and the sixth strand at a predetermined distance below the thirteenth knot and the fifteenth knot;

a seventeenth knot tied in the second strand and the third strand at a predetermined distance below the thirteenth knot and the fourteenth knot;

an eighteenth knot tied in the fourth strand and the fifth strand at a predetermined distance below the fourteenth knot and the fifteenth knot; and a third support tied knot in said first, second, third, fourth, fifth and sixth strands at a predetermined distance below the sixteenth knot, the seventeenth knot, and the eighteenth knot; wherein, a third plant pot is configured to rest on the third support knot;

a nineteenth knot tied in the first strand and the second strand at a predetermined distance below the third support knot;

a twentieth knot tied in the third strand and the fourth strand at a predetermined distance below the third support knot, and a twenty-first knot tied in the fifth strand and the sixth strand at a predetermined distance below the third support knot wherein the first strand and the second strand are created from the first rope, the third strand and the fourth strand are created from the second rope, and the fifth strand and the sixth strand are created from the third rope wherein the first strand and the second strand are tied together directly below and adjacent the first support knot, the third strand and the fourth strand are tied together directly below and adjacent the first support knot, and the fifth strand and the sixth strand are tied together directly below and adjacent the first support knot, wherein said three-tiered potted plant holder is adjustable in size.

* * * * *